US010456615B1

(12) United States Patent
Anthony

(10) Patent No.: US 10,456,615 B1
(45) Date of Patent: Oct. 29, 2019

(54) PNEUMATIC EXERCISE DEVICE

(71) Applicant: Raymond Anthony, Middletown, RI (US)

(72) Inventor: Raymond Anthony, Middletown, RI (US)

( * ) Notice: Subject to any disclaimer, the term of this patent is extended or adjusted under 35 U.S.C. 154(b) by 46 days.

(21) Appl. No.: 15/859,812

(22) Filed: Jan. 2, 2018

(51) Int. Cl.
*A63B 21/008* (2006.01)
*A63B 21/00* (2006.01)
(Continued)

(52) U.S. Cl.
CPC .... *A63B 21/0087* (2013.01); *A63B 21/00069* (2013.01); *A63B 21/169* (2015.10);
(Continued)

(58) Field of Classification Search
CPC ..... A63B 21/00058; A63B 21/00069; A63B 21/00072; A63B 21/00076; A63B 21/00178; A63B 21/00181; A63B 21/00185; A63B 21/002; A63B 21/0023; A63B 21/008; A63B 21/0085; A63B 21/0087; A63B 21/0088; A63B 21/0615; A63B 21/0616; A63B 21/0617; A63B 21/065; A63B 21/068; A63B 21/08; A63B 21/15; A63B 21/159; A63B 21/16; A63B 21/169; A63B 21/4027; A63B 21/4033; A63B 21/4035; A63B 21/4041; A63B 21/4045; A63B 21/4047; A63B 21/4049; A63B 23/035; A63B 23/03508; A63B 23/03516; A63B 23/03533; A63B 23/03541; A63B 23/12; A63B 23/1209; A63B 23/1218; A63B 23/1227; A63B 23/1236; A63B 23/1245; A63B 23/1281; A63B 71/0054; A63B 2071/0063; A63B 2071/0072; A63B 2071/0081; A63B 2071/009; A63B 2209/0204; A63B 2209/0295; A63B 2209/00;
(Continued)

(56) References Cited

U.S. PATENT DOCUMENTS 3,174,343 A * 3/1965 Kasulis ..... A63B 21/0087 482/112
3,471,145 A * 10/1969 Berger ..... A63B 21/00072 482/112
(Continued)

FOREIGN PATENT DOCUMENTS

WO 1991014482 10/1991

*Primary Examiner* — Gary D Urbiel Goldner

(57) ABSTRACT

The pneumatic exercise device comprises a resistance base and an ergonomic handle. The pneumatic exercise device may be used in pairs to perform exercises and physical therapy. The resistance base provides resistance to movement of the ergonomic handle. The ergonomic handle is coupled to a shaft projecting from a top of the resistance base. Another end of the shaft is coupled to a piston within an air cylinder inside a housing of the resistance base. A pressure differential of an air caused movement of the piston creates the resistance. An amount of resistance may be changed by sliding a resistance adjustment lever on a side of the housing. The angle of the ergonomic handle is adjustable by pressing a pivot release on the side of the ergonomic handle. The pneumatic exercise device may include an auxiliary platform used to elevate a user's feet during exercise.

12 Claims, 4 Drawing Sheets

(51) Int. Cl.
*A63B 23/12* (2006.01)
*A63B 21/16* (2006.01)

(52) U.S. Cl.
CPC ..... *A63B 21/4035* (2015.10); *A63B 21/4045* (2015.10); *A63B 23/1236* (2013.01); *A63B 2209/00* (2013.01); *A63B 2225/093* (2013.01)

(58) Field of Classification Search
CPC ..... A63B 2210/00; A63B 2210/50; A63B 2225/09; A63B 2225/093
See application file for complete search history.

(56) References Cited

U.S. PATENT DOCUMENTS 4,290,599 A * 9/1981 Berger ..... A63B 21/00072 482/112
4,772,016 A * 9/1988 Manion ..... A63B 21/0004 482/112
4,832,335 A 5/1989 Tong
4,880,230 A 11/1989 Cook
5,372,564 A * 12/1994 Spirito ..... A63B 23/03533 482/111
5,385,524 A 1/1995 Jahoda
5,529,559 A * 6/1996 Punzalan ..... A63B 21/00072 482/111
6,976,943 B1 12/2005 Hsiung
7,134,987 B2 11/2006 Goldstein
7,569,003 B1 * 8/2009 Huffman ..... A63B 21/00043 482/111
D622,333 S 8/2010 Eckermann
7,780,583 B2 8/2010 Brown
9,101,790 B2 8/2015 Parnell
2002/0160890 A1 * 10/2002 Fazio ..... A63B 21/00072 482/112
2003/0017920 A1 * 1/2003 Fazio ..... A63B 21/0004 482/112
2003/0162638 A1 * 8/2003 Verheem ..... A63B 21/05 482/123
2013/0324376 A1 * 12/2013 Colby ..... A63B 21/008 482/112
2014/0148316 A1 * 5/2014 Tsuchio ..... A63B 21/0087 482/112
2017/0072241 A1 * 3/2017 Pena-Ruiz ..... A63B 21/0087
2017/0354847 A1 * 12/2017 Carter ..... F16B 47/003
2018/0200574 A1 * 7/2018 Connolly ..... A63B 21/0004

* cited by examiner

PNEUMATIC EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise equipment, more specifically, a pneumatic exercise device.

SUMMARY OF INVENTION

The pneumatic exercise device comprises a resistance base and an ergonomic handle. The pneumatic exercise device may be used in pairs to perform exercises and physical therapy. The resistance base provides resistance to the movement of the ergonomic handle. The ergonomic handle is coupled to a shaft projecting from the top of the resistance base. The other end of the shaft is coupled to a piston within an air cylinder inside the housing of the resistance base. A pressure differential of the air caused movement of the piston creates the resistance. The amount of resistance may be changed by sliding a resistance adjustment lever on the side of the housing or turning the valve left or right to adjust the degree of resistance. The angle of the ergonomic handle is adjustable by pressing a pivot release on the side of the handle. The invention may further comprises an auxiliary platform used to elevate the feet during exercise.

An object of the invention is to provide an air resistance device usable for exercising and therapy purposes.

Another object of the invention is to allow adjustment of the handle angle.

A further object of the invention is to allow adjustment of the air resistance.

Yet another object of the invention is to provide an auxiliary platform for elevating the feet during exercise sessions, which is ideally used during push ups.

These together with additional objects, features and advantages of the pneumatic exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the pneumatic exercise device in detail, it is to be understood that the pneumatic exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pneumatic exercise device.

It is therefore important that the claims be regarded as including such equivalent construction insofar as they do not depart from the spirit and scope of the pneumatic exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
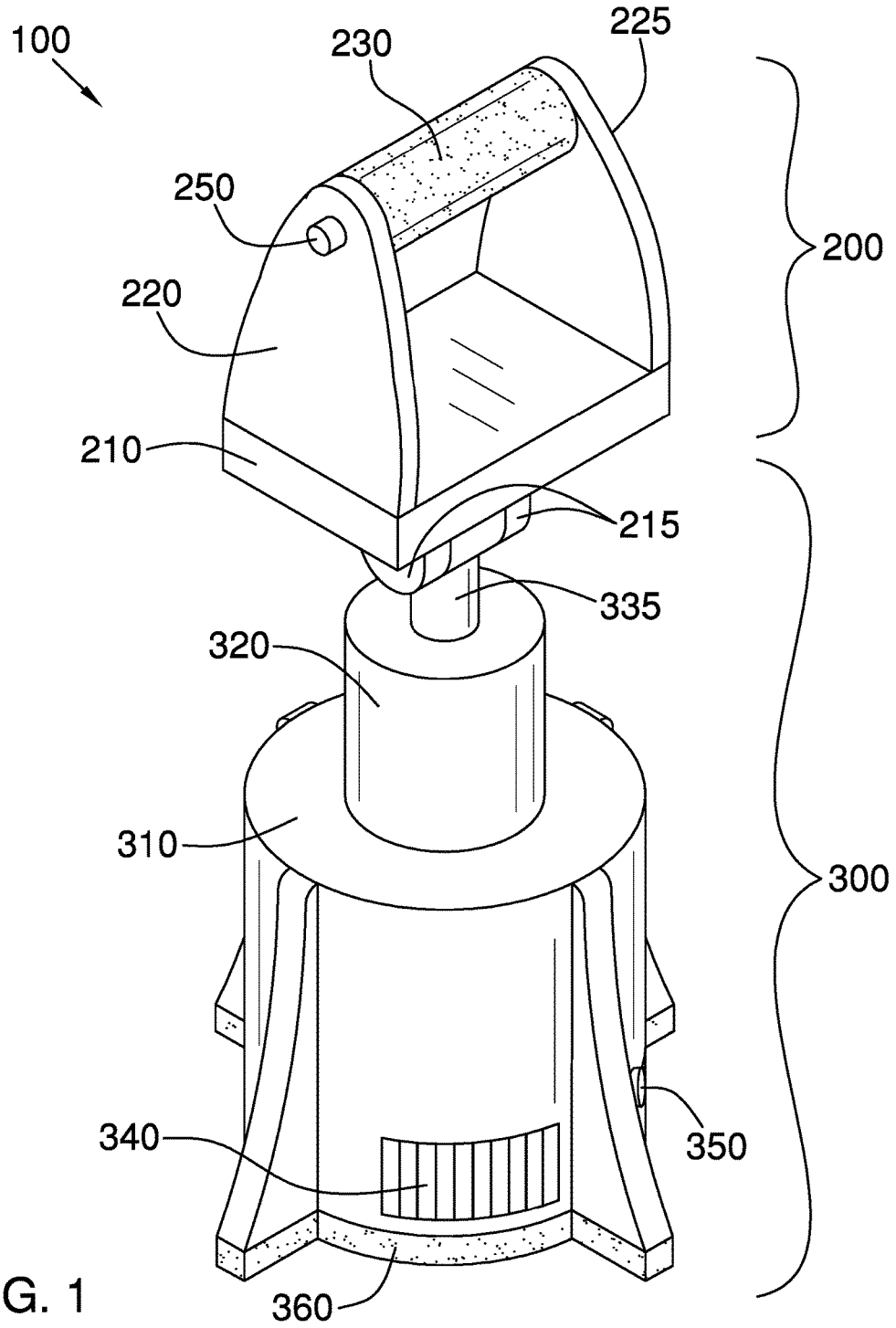
FIG. 1 is a perspective view of an embodiment of the disclosure.
Figure 2:
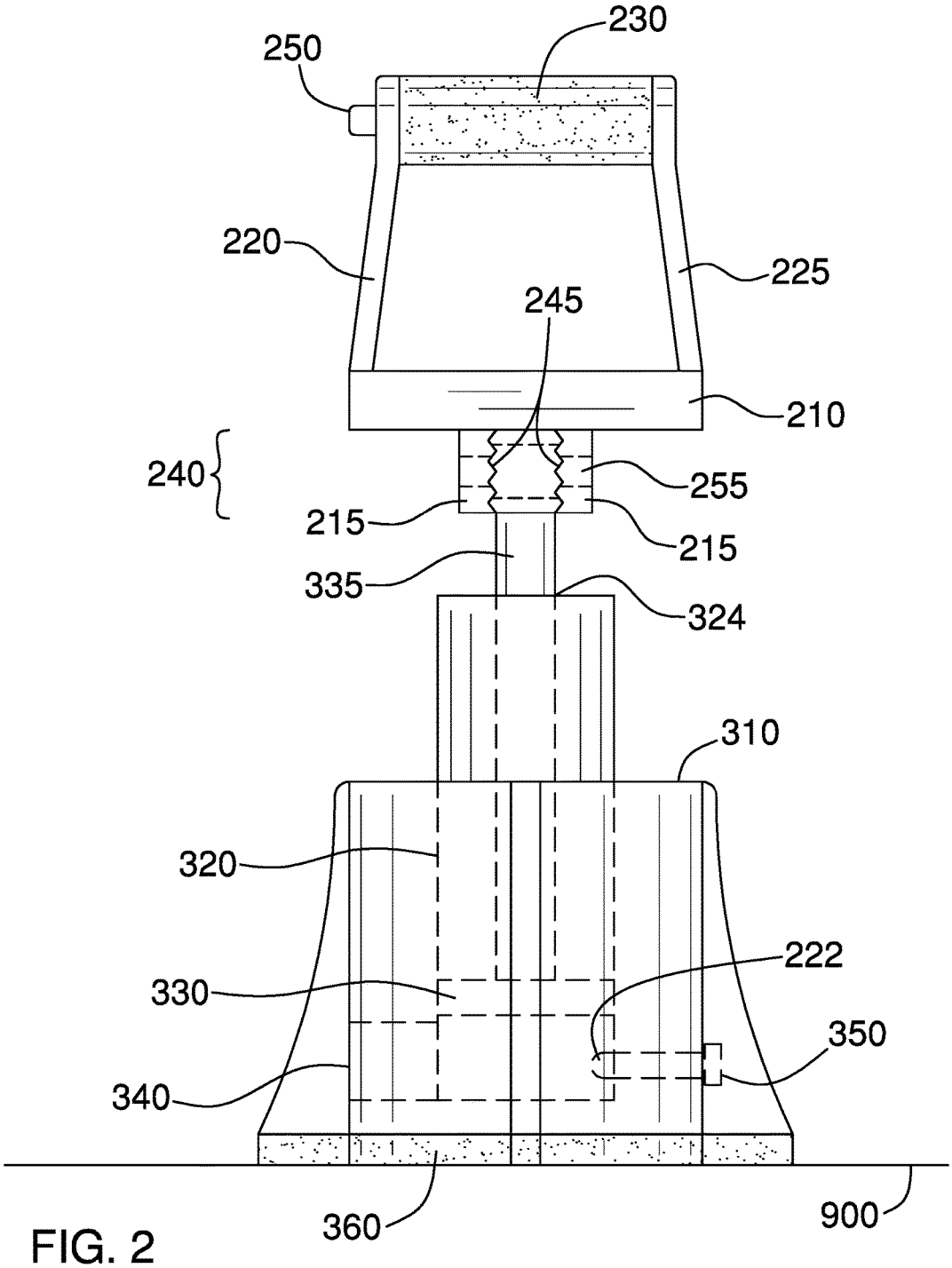
FIG. 2 is a front view of an embodiment of the disclosure.
Figure 3:
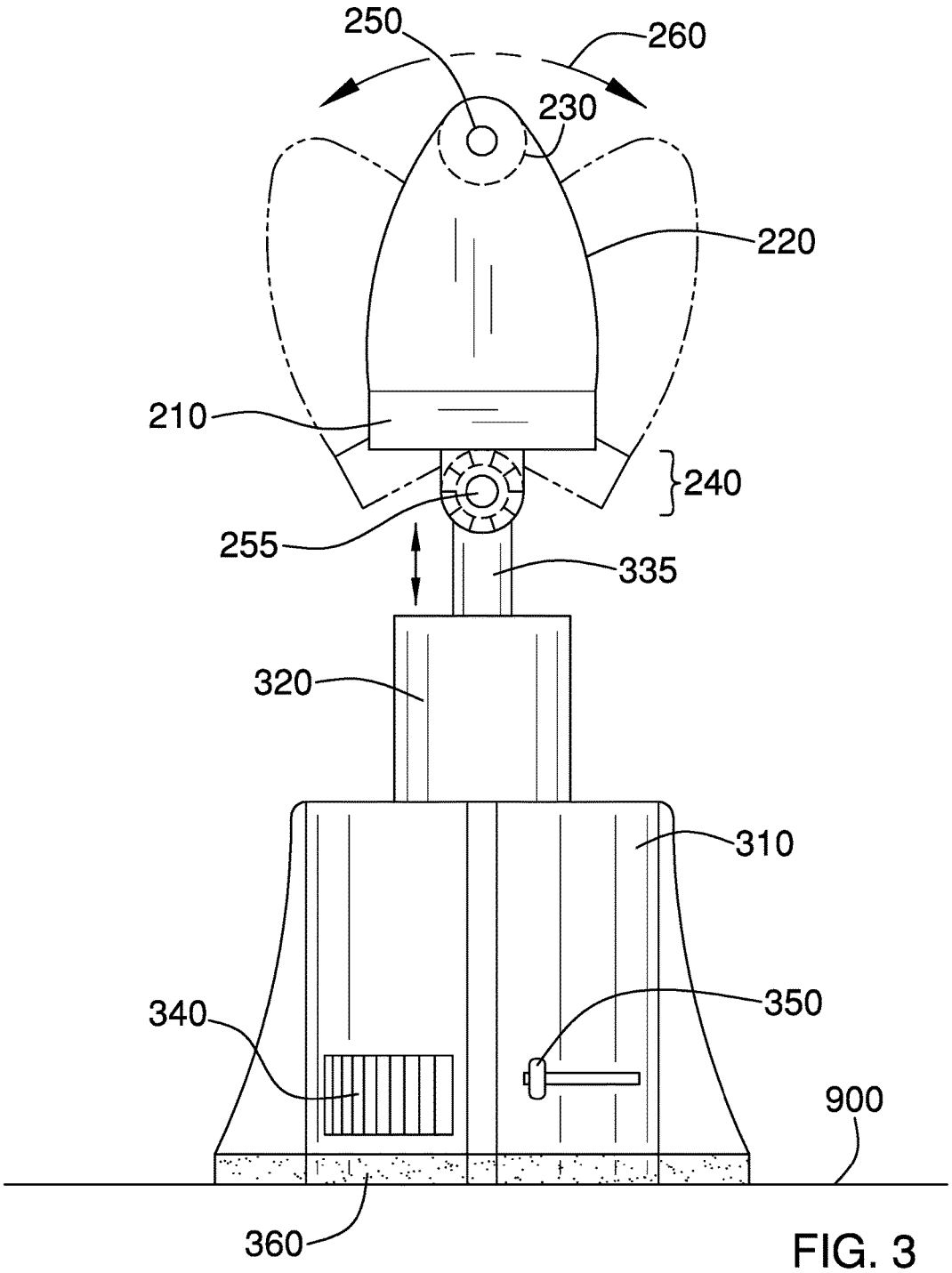
FIG. 3 is a side view of an embodiment of the disclosure.
Figure 4:
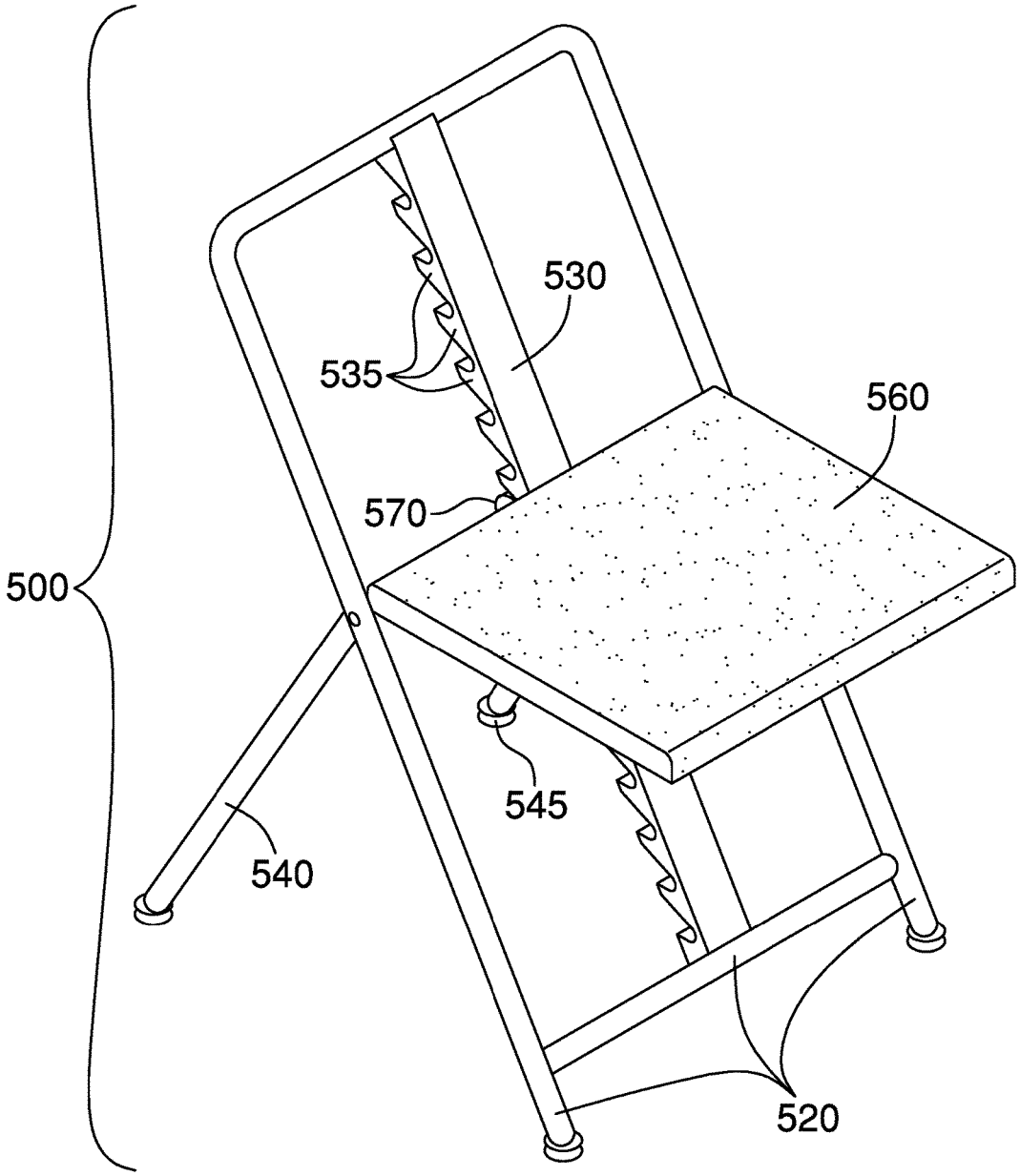
FIG. 4 is a perspective view of an embodiment of the disclosure illustrating the auxiliary platform.

Detailed reference will now be made to a first potential embodiment of the disclosure, which is illustrated in FIGS. 1 through 4.

The pneumatic exercise device 100 (hereinafter invention) comprises an ergonomic handle 200 and a resistance base 300. The invention 100 is a resistance device that may be used during exercise or therapy. Two of the inventions 100 may be used together to perform exercises or therapies where one of the inventions 100 is pulled while the other is pushed, and vice versa. As a non-limiting example, two of the inventions 100 may be used together to perform a pushup-like exercise where the inventions 100 are placed upon a floor 900 and one is pulled up while the other is pushed down, and vice versa. As a further non-limiting example, two of the inventions 100 may be used together to perform a standing exercise where the inventions 100 are mounted to a wall at shoulder height and one is pulled up while the other is pushed down, and vice versa.

The ergonomic handle 200 comprises a handle base 210, a left handle upright 220, a right handle upright 225, a grip 230, and a pivot joint 240. The ergonomic handle 200 is adapted to provide a grasping point for a user to hold while using the invention 100.

The handle base 210 may be a horizontally oriented plate. The center, underside of the handle base 210 may be coupled to the pivot joint 240. The top, left side of the handle base 210 may be coupled to the left handle upright 220 and the top, right side of the handle base 210 may be coupled to the right handle upright 225. The handle base 210 may be fabricated from a rigid material. The left handle upright 220 may be a rigid support that couples the left side of the handle base 210 to the left side of the grip 230. The right handle upright 225 may be a rigid support that couples the right side of the handle base 210 to the right side of the grip 230. The left handle upright 220 may comprise a pivot release 250. Depressing the pivot release 250 may release the pivot joint 240 and allow the pivot joint 240 to change a pivot angle 260.

The grip 230 may be a cylindrical handle disposed between the top of the left handle upright 220 and the top of the right handle upright 225. The grip 230 may be used to pull or push the invention 100. The grip 230 may be covered with a padding material to enhance comfort. As a non-limiting example, the padding material may be rubber, neoprene, or silicone.

The pivot joint 240 comprises a pivot axle 255, a pivot latch 245, and the pivot release 250. The pivot joint 240 may couple the ergonomic handle 200 to a piston shaft 335. The pivot joint 240 may allow the pivot angle 260 of the ergonomic handle to change.

The pivot axle 255 may be a cylindrical bar, which the ergonomic handle 200 uses as a center of rotation. The center of the pivot axle 255 may be coupled to the piston shaft 335. The left end of the pivot axle 255 and the right end of the pivot axle 255 may be pivotally coupled to a pair of downward projections 215 of the handle base 210.

The pivot latch 245 may be a mechanical interference between the pivot axle 255 and the handle base 210 such that when the pivot latch 245 is in a locked position the ergonomic handle 200 will not pivot and when the pivot latch 245 is in a unlocked position the ergonomic handle 200 will pivot. In some embodiments, the mechanical interference may take the form of two toothed disks that press together when the pivot latch 245 is in the locked position and which separate when the pivot latch 245 is in the unlocked position.

The pivot release 250 may be a button connected to a linkage (not illustrated in the figures). The linkage may comprise one or more rods, levers, springs, pivots, or other mechanical components that convey depressions of the pivot release 250 to the pivot latch 245 such that depressing the pivot release 250 results in the pivot latch 245 disengaging and releasing the pivot release 250 results in the pivot latch 245 engaging.

The resistance base 300 comprises a housing 310, an air cylinder 320, a piston 330, an air intake 340, a resistance adjustment lever 350, and a padded base 360. The resistance base 300 may be a base to hold the ergonomic handle 200 above the floor 900, to provide stability for the invention 100 as pressure is applied to the ergonomic handle 200, and to create resistance to the movement of the ergonomic handle 200.

The housing 310 may be an enclosure for the air cylinder 320, the piston 330, and the resistance adjustment lever 350. The housing 310 may widen the footprint of the resistance base 300 beyond the diameter of the air cylinder 320 to increase stability of the resistance base 300. The housing 310 may comprise fins or other projections from the side of the housing 310 to widen the housing 310 at the bottom of the housing 310. The housing 310 may comprise the air intake 340 to allow air to flow freely into and out of the resistance base 300. The housing 310 may further provide access to the resistance adjustment lever 350 to adjust the amount of resistance to the movement of the ergonomic handle 200.

The air cylinder 320 may be a chamber in which the piston 330 is moved up and down. The air cylinder 320 may comprise one or more air apertures 322 located at the top of the air cylinder 320, at the bottom of the air cylinder 320, on the sides of the air cylinder 320, or combinations thereof. The one or more air apertures 322 may allow the air to flow into or out of the air cylinder 320. The piston shaft 335 may run from the piston 330 to the ergonomic handle 200 via a shaft aperture 324 at the top end of the air cylinder 320. The shaft aperture 324 may allow the piston shaft 335 to slide into and out of the air cylinder 320.

The piston 330 may be a round disk located within the air cylinder 320 and oriented to lie in a plane that is parallel to the ends of the air cylinder 320. The center, top of the piston 330 may be coupled to the bottom of the piston shaft 335. The side of the piston 330 may form a slidable, air-tight seal with the inside walls of the air cylinder 320. In some embodiments, the slidable, air-tight seal may comprise an O-ring or other form of piston ring. In some embodiments, the piston 330 may comprise apertures, flaps, or valves passing through the piston 330 from top to bottom to allow the air in the space above the piston 330 to pass to the space below the piston 330 in a controlled manner, or vice versa.

Movement of the piston 330 within the air cylinder 320 may force the movement of the air both above and below the piston 330 and/or may create a pressure imbalance between the space above the piston 330 and the space below the piston 330.

The invention 100 provides resistance to the movement of the ergonomic handle 200 through the interaction of the air cylinder 320, the piston 330, the piston shaft 335, and the air. When the ergonomic handle 200 is pulled or pushed, the piston shaft 335 causes the piston 330 to move. When the piston 330 moves in either direction at a first velocity, the surface area of the piston 330 multiplied by distance that the piston 330 moves within the air cylinder 320 defines a volume of air that is displaced by the piston 330. The volume of air must pass into or out of the air cylinder 320 through the one or more air apertures 322, however the area of the one or more air apertures 322 may be smaller than the surface area of the piston 330 and therefore the volume of air must flow at a second velocity where the second velocity is greater than the first velocity. The flow of the air at the second velocity through the one or more air apertures 322 may cause turbulent air flow which increases the resistance of the airflow. The increased or decreased pressure of the air being forced into or out of the air cylinder 320 may be perceived as resistance to the movement of the ergonomic handle 200.

The air intake 340 may be an aperture that allows the air to flow into and out of the housing 310 so that the air may reach the one or more air apertures 322 in the air cylinder 320.

The resistance adjustment lever 350 may be a control that sets the amount of resistance presented by the invention 100.

The resistance adjustment lever 350 may change the size of the one or more air apertures 322 on the air cylinder 320. When the resistance adjustment lever 350 covers more of the one or more air apertures 322 the resistance to movement of the ergonomic handle 200 may increase and when the resistance adjustment lever 350 covers less of the one or more air apertures 322 the resistance to movement of the ergonomic handle 200 may decrease.

The padded base 360 may be a non-slip surface applied to the bottom of the housing 310. The padded base 360 may cover all or part of the bottom of the housing 310.

The invention 100 may further comprise an auxiliary platform 500. The auxiliary platform 500 may be adapted to elevate the feet of the user while using the ergonomic handle 200 and the resistance base 300.

The auxiliary platform 500 comprises a support frame and a platform 560. The support frame comprises a main frame 520, a left rear leg 540, a right rear leg 545, and a toothed rack 530. The main frame 520 may be a rectangular framework that rests on the floor 900 at the bottom front and is included up and to the rear during use. The toothed rack 530 may be coupled to the main frame 520. The toothed rack 530 may be disposed to run from the bottom center of the main frame 520 to the top center of the main frame 520. A plurality of teeth 535 on the toothed rack 530 may be oriented towards the rear of the main frame 520.

The left rear leg 540 may be coupled to the center of left side of the main frame 520. The left rear leg 540 is oriented to project downwards and towards the rear until it contacts the floor 900. The right rear leg 545 may be coupled to the center of right side of the main frame 520. The right rear leg 545 is oriented to project downwards and towards the rear until it contacts the floor 900. The left rear leg 540, the right rear leg 545, and the bottom of the main frame 520 comprise a stable base for the auxiliary platform 500.

The platform 560 may be a horizontal surface adapted for the user to place their feet on while performing exercises. The platform 560 may be padded for comfort. The platform 560 may ratchetedly couple to the toothed rack 530 via a platform latch 570. Specifically, the platform latch 570 may engage the plurality of teeth 535 on the toothed rack 530 when the platform 560 is horizontal and may hold the platform 560 at a fixed height above the floor 900. Lifting the front of the platform 560 up may cause the platform latch 570 to disengage from the plurality of teeth 535 on the toothed rack 530 and may allow the platform 560 to slide up or down to a new height.

In use, the user may place two of the resistance bases 300 on the floor 900, separated by approximately a shoulders width. The user may place their hands on the ergonomic handles 200 attached to the resistance bases 300 and then move their feet away from the resistance bases 300 until the user is inclined in a pushup-like position. The user may then alternately pull one of the ergonomic handles 200 up while pushing the other down.

The user may modify the exercise by placing the auxiliary platform 500 at their feet and lifting both feet up onto the auxiliary platform 500 to change the angle of their body.

The resistance bases 300 may also be mounted to the wall with the piston shaft 335 oriented horizontally. The user may stand in front of the wall and grasp the ergonomic handle 200 in each hand. The user may perform physical therapy exercises by alternately pushing and pulling the ergonomic handles 200.

The user may adjust the resistance offered by either or both of the resistance bases 300 by sliding the resistance adjustment lever 350 on the resistance base 300 that needs adjustment.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used herein, "approximate" and "approximately" indicate that information that is being presented is not critical for proper functioning of the invention and that the information is being provided only to assist in a better understanding of some physical characteristic of an embodiment of the invention. As a non-limiting example, a device that is described as "cubical and approximately 1 inch long on each side" is not required to be precisely 1 inch long on each side and the reader may understand that the device will likely fit in their pocket.

As used in this disclosure, an "axle" is a cylindrical shaft that is inserted through the center of an object such that the center axis of the object and the center axis of the axle are aligned and the object can rotate using the axle as an axis of rotation.

As used in this disclosure, the "center of rotation" is the point of a rotating plane that does not move with the rotation of the plane. A line within a rotating three-dimensional object that does not move with the rotation of the object is also referred to as an axis of rotation.

As used herein, the words "couple", "couples", "coupled" or "coupling", refer to connecting, either directly or indirectly, and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder, which is defined as a cylinder wherein the curved surface perpendicularly intersects with the two identical flat and parallel ends.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "disk" is a cylindrically shaped object that is flat in appearance. A disk generally has a thickness (as measured from flat side to flat side) that is less than the radius of the cylinder.

As used in this disclosure, a "footprint" is the surface area occupied by an object.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "grip" is a covering that is placed over a hand hold, handle, shaft, or other object.

As used in this disclosure, a "handle" is an object by which a tool, object, or door is held or manipulated with the hand.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, a "housing" is a rigid casing that encloses and protects one or more devices.

As used in this disclosure, a "latch" is a fastening or locking mechanism. The use of the term latch may imply the insertion of an object into a notch or cavity. The act of latching may involve a linear, pivoting, or rotating motion.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, a "plate" is a smooth, flat and rigid object having at least one dimension that is of uniform thickness and appears thinner than the other dimensions of the object. Plates often have a rectangular or disk like appearance. Plates may be made of any material, but are commonly made of metal.

As used in this disclosure, the term "shaft" is used to describe a rigid cylinder that is often used as the handle of a tool or implement. The definition of shaft explicitly includes solid shafts or shafts that comprise a hollow passage through the shaft along the center axis of the shaft cylinder, whether the shaft has one or more sealed ends or not.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "stable" is an adjective that is applied to the state an object or system is in wherein the stable state of the object or system will not change unless: 1) a force is applied to or removed from the object or system; or, 2) a change is made to the energy stored within the system. Objects in a stable state my informally be referred to as in equilibrium.

As used in this disclosure, a "valve" is a device that is used to control the flow of a fluid (gas or liquid) through a pipe or to control the flow of a fluid into and out of a container.

As used in this direction, the "velocity" is a vector or a function that describes: 1) the rate of change of position of an object with respect to time (often called speed); and, 2) the direction of the change of position of the object.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A pneumatic exercise device comprising:

an ergonomic handle and a resistance base;

wherein the pneumatic exercise device is a resistance device that is used during exercise or therapy;

wherein two of the pneumatic exercise devices are used together to perform exercises or therapies where one of the pneumatic exercise devices is pulled while the other is pushed, and vice versa;

wherein the ergonomic handle comprises a handle base, a left handle upright, a right handle upright, a grip, and a pivot joint;

wherein the ergonomic handle is adapted to provide a grasping point for a user to hold while using the pneumatic exercise device;

wherein the handle base is a horizontally oriented plate;

wherein a center, underside of the handle base is coupled to the pivot joint;

wherein a top, left side of the handle base is coupled to the left handle upright and a top, right side of the handle base is coupled to the right handle upright;

wherein the handle base is fabricated from a rigid material;

wherein the left handle upright is a rigid support that couples a left side of the handle base to a left side of the grip;

wherein the right handle upright is a rigid support that couples a right side of the handle base to a right side of the grip;

wherein the left handle upright comprises a pivot release;

wherein depressing the pivot release releases the pivot joint and allows the pivot joint to change a pivot angle;

wherein the grip is a cylindrical handle disposed between a top of the left handle upright and a top of the right handle upright;

wherein the grip is used to pull or push the pneumatic exercise device;

wherein the grip is covered with a padding material to enhance comfort;

wherein the pivot joint comprises a pivot axle, a pivot latch, and the pivot release;

wherein the pivot joint couples the ergonomic handle to a piston shaft;

wherein the pivot joint allows the pivot angle of the ergonomic handle to change;

wherein the pivot axle is a cylindrical bar which the ergonomic handle uses as a center of rotation;

wherein a center of the pivot axle is coupled to the piston shaft;

wherein a left end of the pivot axle and a right end of the pivot axle is pivotally coupled to a pair of downward projections of the handle base.

2. The pneumatic exercise device according to claim 1 wherein the pivot latch is a mechanical interference between the pivot axle and the handle base such that when the pivot latch is in a locked position the ergonomic handle will not pivot and when the pivot latch is in an unlocked position the ergonomic handle will pivot.

3. The pneumatic exercise device according to claim 2 wherein the pivot release is a button connected to a linkage;

wherein the linkage comprises one or more mechanical components that convey depressions of the pivot release to the pivot latch such that depressing the pivot release results in the pivot latch being placed into the unlocked position and releasing the pivot release results in the pivot latch being placed into the locked position.

4. The pneumatic exercise device according to claim 3 wherein the resistance base comprises a housing, an air cylinder, a piston, an air intake, a resistance adjustment lever, and a padded base;

wherein the resistance base is a base to hold the ergonomic handle above a floor, to provide stability for the pneumatic exercise device as pressure is applied to the ergonomic handle, and to create resistance to a movement of the ergonomic handle.

5. The pneumatic exercise device according to claim 4 wherein the housing is an enclosure for the air cylinder, the piston, and the resistance adjustment lever;

wherein the housing widens a footprint of the resistance base beyond a diameter of the air cylinder to increase stability of the resistance base;

wherein the housing comprises projections from a side of the housing to widen the housing at a bottom of the housing;

wherein the housing comprises the air intake to allow air to flow freely into and out of the resistance base;

wherein the housing comprises the resistance adjustment lever to adjust an amount of resistance to the movement of the ergonomic handle.

6. The pneumatic exercise device according to claim 5 wherein the air cylinder is a chamber in which the piston is moved up and down;

wherein the air cylinder comprises one or more air apertures located at a top of the air cylinder, at a bottom of the air cylinder, on sides of the air cylinder, or combinations thereof;

wherein the one or more air apertures allow the air to flow into or out of the air cylinder;

wherein the piston shaft runs from the piston to the ergonomic handle via a shaft aperture at a top end of the air cylinder;

wherein the shaft aperture allows the piston shaft to slide into and out of the air cylinder.

7. The pneumatic exercise device according to claim 6 wherein the piston is a round disk located within the air cylinder and oriented to lie in a plane that is parallel to the top and bottom of the air cylinder;

wherein a center, top of the piston is coupled to a bottom of the piston shaft;

wherein a side of the piston forms a slidable, air-tight seal with inside walls of the air cylinder.

8. The pneumatic exercise device according to claim 7 wherein the piston comprises apertures, flaps, or valves passing through the piston from top to bottom to allow the air in a space above the piston to pass to a space below the piston in a controlled manner, or vice versa.

9. The pneumatic exercise device according to claim 8 wherein movement of the piston within the air cylinder forces the movement of the air both above and below the piston and/or creates a pressure imbalance between the space above the piston and the space below the piston.

10. The pneumatic exercise device according to claim 9 wherein the air intake is an aperture that allows the air to flow into and out of the housing so that the air reaches the one or more air apertures in the air cylinder.

11. The pneumatic exercise device according to claim 10 wherein the resistance adjustment lever is a control that sets the amount of resistance presented by the pneumatic exercise device;

wherein the resistance adjustment lever changes a size of the one or more air apertures on the air cylinder;

wherein when the resistance adjustment lever covers more of the one or more air apertures the resistance to movement of the ergonomic handle increases and when the resistance adjustment lever covers less of the one or more air apertures the resistance to movement of the ergonomic handle decreases.

12. The pneumatic exercise device according to claim 11 wherein the padded base is a non-slip surface applied to the bottom of the housing;

wherein the padded base covers all or part of the bottom of the housing.

* * * * *